US007553176B2

(12) United States Patent
Naito et al.

(10) Patent No.: US 7,553,176 B2
(45) Date of Patent: Jun. 30, 2009

(54) CONNECTOR CAPABLE OF CONNECTING A CONNECTION OBJECT IN AN EASILY EXCHANGEABLE MANNER

(75) Inventors: Takeharu Naito, Tokyo (JP); Kazuaki Ibaraki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/978,100

(22) Filed: Oct. 26, 2007

(65) Prior Publication Data

US 2008/0119092 A1 May 22, 2008

(30) Foreign Application Priority Data

Nov. 17, 2006 (JP) ..... 2006-311386

(51) Int. Cl.
*H01R 33/08* (2006.01)

(52) U.S. Cl. ..... 439/239

(58) Field of Classification Search ..... 439/232, 439/239, 342, 159, 226, 241; 362/92; 349/58
See application file for complete search history.

(56) References Cited

U.S. PATENT DOCUMENTS 5,886,758 A * 3/1999 Ibaraki ..... 349/58
7,137,841 B1 * 11/2006 Liao et al. ..... 439/342
7,303,421 B2 * 12/2007 Liao ..... 439/342
7,344,397 B2 * 3/2008 Miyazono ..... 439/232
7,361,044 B1 * 4/2008 Pandey et al. ..... 439/342

FOREIGN PATENT DOCUMENTS

| | | |
|---|---|---|
| JP | 52-88376 | 7/1977 |
| JP | 61-193686 | 12/1986 |
| JP | 62-193030 | 8/1987 |
| JP | 7-130437 | 5/1995 |
| JP | 7-030482 U | 6/1995 |
| JP | 2008-084856 | 4/2008 |

OTHER PUBLICATIONS

Japanese Office Action dated Sep. 24, 2008.

* cited by examiner

*Primary Examiner*—Alexander Gilma
(74) *Attorney, Agent, or Firm*—Collard & Roe, P.C.

(57) ABSTRACT

In a connector for connecting first and second objects to each other, a contact includes a first connecting portion to be connected to the first object, a second connecting portion to be connected to the second object, and a holding portion held by a housing. The first connecting portion includes a pair of coupling portions extending from a base portion and faced to each other and a pair of contacting portions extending from the coupling portions, respectively, and faced to each other. Each of the contacting portions includes a fitting portion coupled to the coupling portion and fitted to the first connection object and a free end extending on a side opposite to the fitting portion. The contact is designed so that, upon connection with the first connection object, a distance between the contacting portions is narrower at the fitting portions than that at the free ends.

13 Claims, 8 Drawing Sheets

CONNECTOR CAPABLE OF CONNECTING A CONNECTION OBJECT IN AN EASILY EXCHANGEABLE MANNER

This application is based upon and claims the benefit of priority from Japanese patent application No. 2006-311386, filed on Nov. 17, 2006, the disclosure of which is incorporated herein in its entirety by reference.

BACKGROUND OF THE INVENTION

This invention relates to a connector for connecting a connection object, such as a fluorescent tube, to another connection object, such as a board.

For example, Japanese Unexamined Utility Model Application (JP-U) No. H7-30482 discloses a fluorescent tube apparatus using a compact fluorescent tube as a connection object. The compact fluorescent tube comprises a tubular sealed member having an inner diameter not greater than 10 mm and a pair of lead rods penetrating the sealed member at opposite ends thereof and extending from the inside to the outside of the sealed member. Each of the lead rod has an inner part inside the sealed member and an outer part outside the sealed member. The inner part of the lead rod is designed to be relatively thin and is provided with a pair of electrodes faced to each other. The outer part of the lead rod is designed to be relatively thick and has an outer diameter between 0.5 and 3 mm. The fluorescent tube apparatus has a holder which is elastically contacted with the outer part of the lead rod to hold the compact fluorescent tube and which is electrically connected to the lead rod.

However, since the lead rod penetrating the sealed member supported by the holder in contact therewith, a load applied to the lead rod is directly transmitted to the sealed member, in particular, that part penetrated by the lead rod. This may result in a damage of the sealed member. For example, in an exchanging operation of the compact fluorescent tube, the lead rod may be applied with a large force so that the sealed member is possibly broken. Taking this problem into consideration, at present, not only the compact fluorescent tube is exchanged but also peripheral devices are exchanged together with the compact fluorescent tube.

SUMMARY OF THE INVENTION

It is therefore an exemplary object of this invention to provide a connector capable of connecting a connection object, such as a fluorescent tube, in an easily exchangeable manner.

It is another exemplary object of this invention to provide a connector capable of suppressing release of a connection object in an anti-connecting direction upon occurrence of vibration or shock.

It is still another exemplary object of this invention to provide a connector capable of preventing a connection object from being applied with an excessive load even if the connection object is connected with axial misalignment.

Other objects of the present invention will become clear as the description proceeds.

According to an exemplary aspect of the present invention, there is provided a connector for connecting a first connection object and a second connection object to each other, the connector comprising a contact and a housing holding the contact, the contact including a first connecting portion to be connected to the first connection object, a second connecting portion to be connected to the second connection object, and a holding portion held by the housing, the first connecting portion including a base portion, a pair of coupling portions extending from the base portion and faced to each other, and a pair of contacting portions extending from the coupling portions, respectively, and faced to each other, each of the contacting portions including a fitting portion coupled to the coupling portion and fitted to the first connection object and a free end extending on a side opposite to the fitting portion, the contact being designed so that, upon connection with the first connection object, a distance between the contacting portions is narrower at the fitting portions than that at the free ends.

DESCRIPTION OF THE EXEMPLARY EMBODIMENT

Referring to FIGS. 1 to 4, description will be made of a connector according to an embodiment of this invention together with a connection object.

Figure 1:
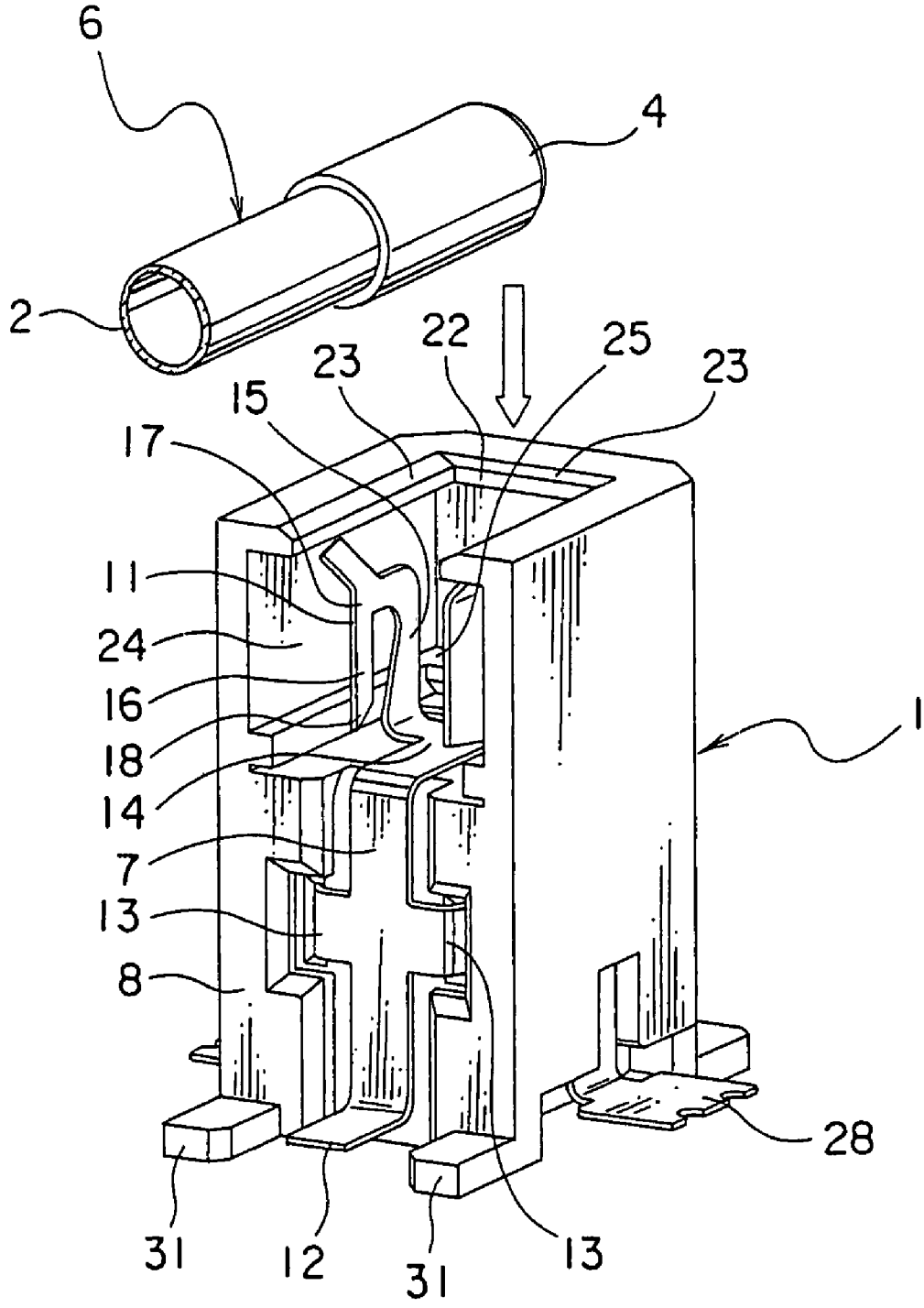
FIG. 1 is a perspective view showing a connector according to an exemplary embodiment of this invention, together with a connection object.

The connector depicted at 1 in FIG. 1 serves to connect a thin long lamp 2, such as a compact fluorescent lamp (CCFL (Cold Cathode Fluorescent Lamp)), in an easily exchangeable manner. For example, the lamp 2 is used as a backlight in various types of liquid crystal displays, such as a liquid crystal television.

Figure 2:
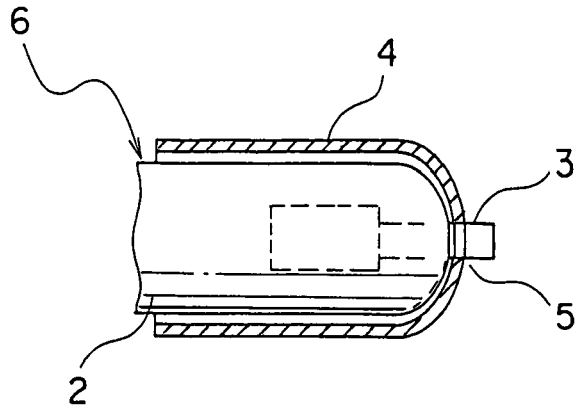
FIG. 2 is a partial sectional view showing only a part of the connection object illustrated in FIG. 1.

As illustrated in FIG. 2, the lamp 2 has pair of conductive dumet wires 3 which protrude outward from longitudinal opposite ends of a tubular sealed member, respectively. The longitudinal opposite ends of the lamp 2 are covered with conductive cylindrical caps or ferrules 4, respectively, fitted thereto. The ferrule 4 is connected to the dumet wire 3 by mechanical connecting means 5 such as soldering or press-contacting. Thus, the ferrule 4 strengthens each of the longitudinal opposite ends of the lamp 2 and prevents the lamp 2 from being directly applied with an external force from the dumet wire 3. A combination of the lamp 2, the ferrules 4, and the dumet wires 3 will hereinafter be called a first connection object 6. The ferrule 4 serves as a connecting portion of the first connection object 6.

Figure 3:
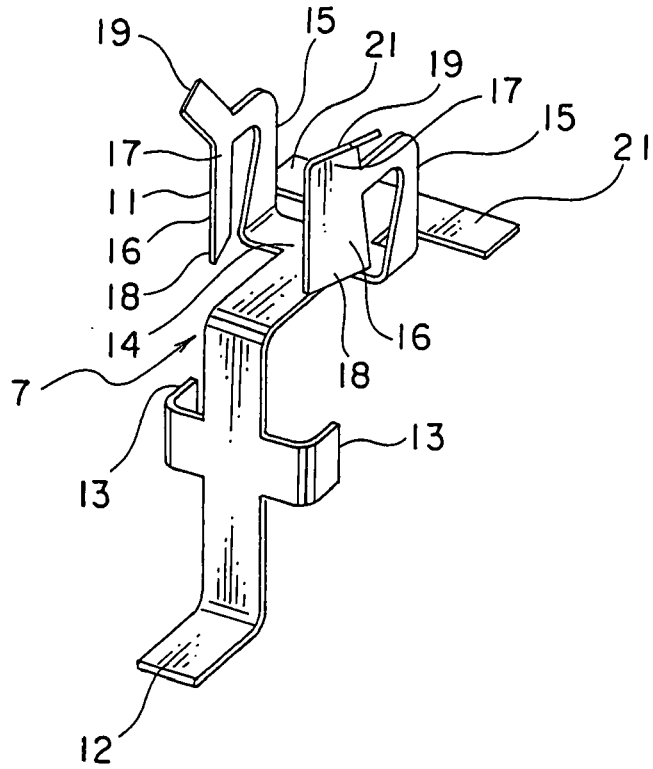
FIG. 3 is a perspective view of a contact used in the connector illustrated in FIG. 1.
Figure 4C:
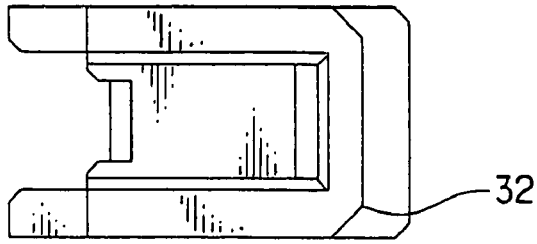
FIG. 4C is a plan view of the housing illustrated in FIG. 4A.
Figure 4A:
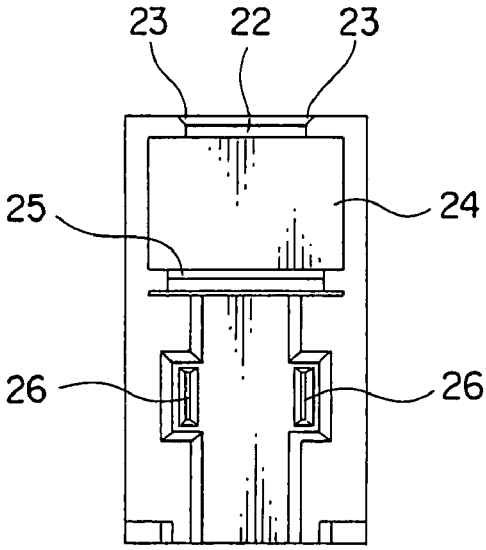
FIG. 4A is a front view of a housing used in the connector illustrated in FIG. 1.
Figure 4B:
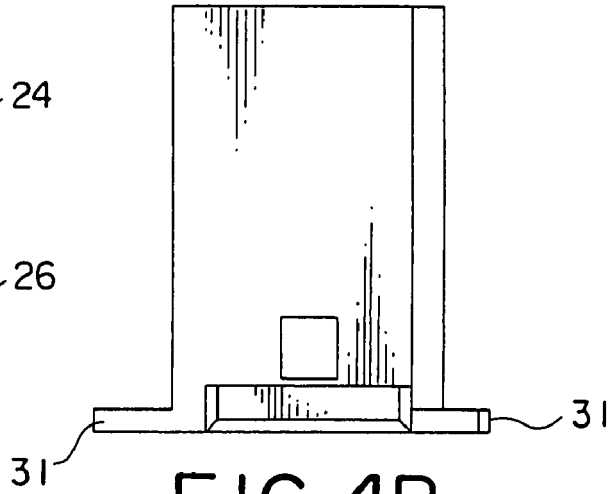
FIG. 4B is a right side view of the housing illustrated in FIG. 4A.
Figure 4D:
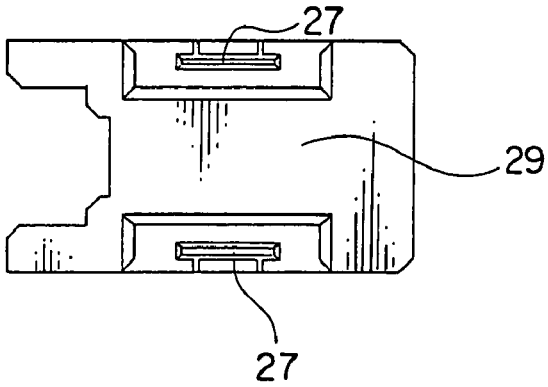
FIG. 4D is a bottom view of the housing illustrated in FIG. 4A.

Turning back to FIG. 1, the connector 1 comprises a conductive contact 7 and an insulating housing 8 holding the contact 7. As illustrated in FIG. 3, the contact 7 has a lamp-side connecting portion, i.e., a first connecting portion 11 to be connected to the ferrule 4 of the first connection object 6, an inverter-board connecting portion, i.e., a second connecting portion 12 to be connected to a second connection object, such as a board, which will later be described, and a press-fit portion or holding portion 13 held by the housing 8 by press-fitting.

The first connecting portion 11 has a base portion 14, a pair of coupling portions 15 extending from the base portion 14 and faced to each other, and a pair of contacting portions 16 respectively extending from the coupling portions 15 and faced to each other. Each of the contacting portions 16 has a fitting portion coupled to the coupling portion 15 and fitted to the ferrule 4, and a free end 18 extending on a side opposite to the fitting portion 17. The fitting portions 17 are provided with a pair of tongue portions 19. The tongue portions 19 extend from the fitting portions 17 outward and away from each other and define an insertion port for insertion of an end portion of the first connection object 6, i.e., the ferrule 4.

The contact 7 is designed so that, upon connection with the first connection object 6, the distance between the contacting portions 16 is narrower at the fitting portions 17 than that at the free ends 18. Therefore, as will later be described in detail, the ferrule 4 fitted to the fitting portions 17 is pressed by the contacting portions 16 towards the base portion 14 and, as a result, contacted with both of the contacting portions 16 and the base portion 14.

The contact 7 further has a pair of stopper portions 21 extending leftward and rightward from the base portion 14 and engaged with the housing 8. When the first connection object 6 is removed from the connector 1, the contact 7 is applied with a releasing force to release the contact 7 from the housing 8. However, since the stopper portions 21 are engaged with the housing 8, the contact 7 is prevented from being released from the housing 8.

Referring to FIGS. 4A to 4D in addition to FIG. 1, the housing 8 will be described.

The housing 8 has an opening portion 22 formed on its upper surface to allow insertion of the end portion of the first connection object 6. The opening portion 22 is provided with a tapered portion 23 formed at its upper edge to facilitate the insertion of the end portion of the first connection object 6. Below the opening portion 22, a cavity 24 is continuously formed. The cavity 24 is opened frontward and adapted to receive the first connecting portion 11. The base portion 14 of the contact 7 is disposed at a bottom of the cavity 24. The stopper portions 21 extend along the bottom of the cavity 24 and are engaged with a stopper rest 25 of the housing 8.

The housing 8 is provided with a contact press-fit hole 26 formed below the cavity 24 and opened frontward. The holding portion 13 of the contact 7 is press-fitted to the contact press-fit hole 26.

The housing 8 is provided with a pair of hold-down press-fit holes 27 formed at bottom ends of left and right side surfaces and receiving a pair of metal hold-downs 28 press-fitted thereto, respectively. The hold-downs 28 serve to maintain the connector 1 at a predetermined position with respect to the second connection object. The housing 8 is provided with a flat sucking surface 29 formed at its bottom between the press-fit holes 27.

Further, the housing 8 has a plurality of stopper protrusions 31 formed at its lower part to prevent the connector 1 from being released from the second connection object. The housing 8 is provided with a distinct-shaped or angled portion 32 formed at its upper part to prevent the connector 1 from being erroneously mounted to the second connection object.

Figure 5A:
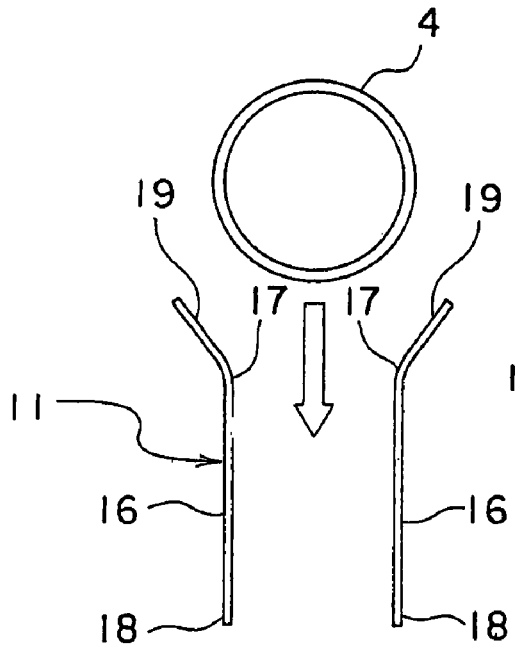
FIG. 5A is a view showing a state before the connection object is connected to the connector, in order to describe an operation of connecting the connector in FIG. 1 and the connection object.
Figure 5B:
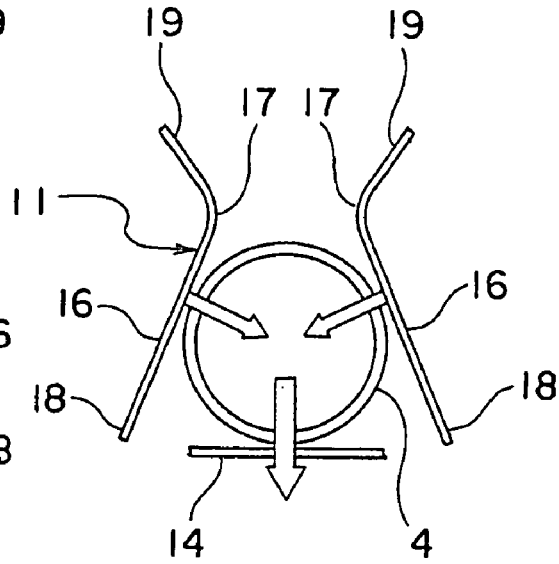
FIG. 5B is a view showing a state after the connection object is connected to the connector.

Referring to FIGS. 5A and 5B, description will be made of an operation of connecting the connector 1 and the first connection object 6.

As illustrated in FIG. 5A, the ferrule 4 is inserted into the first connecting portion 11. Because the ferrule 4 is guided by the tongue portions 19, the ferrule 4 is smoothly inserted into the first connecting portion 11. After the ferrule 4 passes over the fitting portions 17, the contacting portions 16 are pressed by the ferrule 4 to be deformed and widened outward towards the bottom. Thereafter, the ferrule 4 is pressed by a component force of a restoring force of the contacting portions 16 to move towards the base portion 14. Finally, the ferrule 4 is contacted with both of the contacting portions 16 and the base portion 14 as illustrated in FIG. 5B.

Figure 6A:
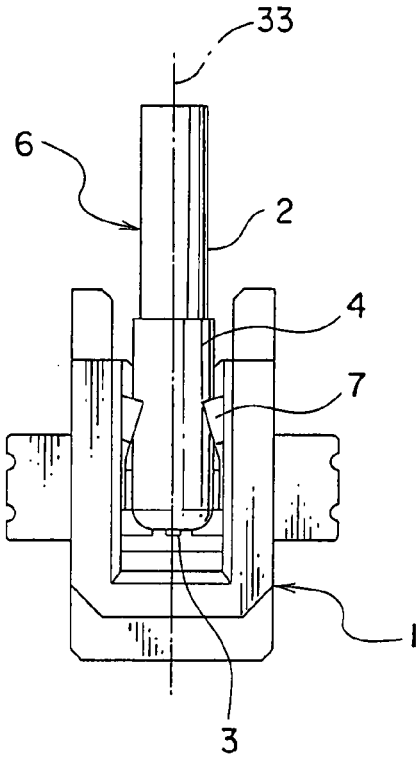
FIG. 6A is a view showing a state where axes of the connector and the connection object are coincident with each other, in order to describe a connecting position of the connector in FIG. 1 and the connection object.
Figure 6B:
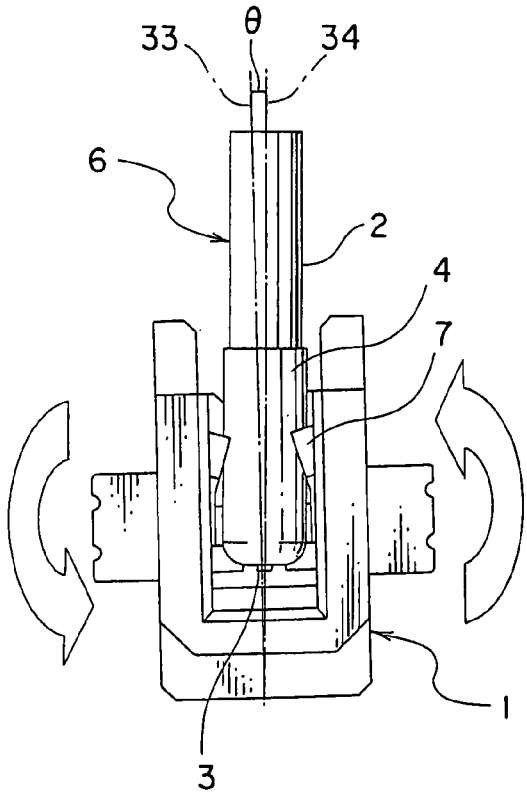
FIG. 6B is a view showing a state where the axis of the connection object is angularly offset from the axis of the connector.

Referring to FIGS. 6A and 6B, description will be made of a connecting position of the connector 1 and the first connection object 6.

FIG. 6A shows a desirable connecting position of the connector 1 and the first connection object 6. Specifically, the first connection object 6 is disposed on an axis 33 of the connector 1. In this case, the first connection object 6 is applied with no unnecessary external force.

It is assumed that, due to misalignment of the connector 1 with respect to the second connection object upon mounting or misalignment during assembling of the second connection object itself, an axis 34 of the first connection object 6 has an inclination angle θ (θ offset) with respect to the axis 33 of the connector 1 as illustrated in FIG. 6B. Even in this event, the contact 7 is stably contacted with the ferrule 4 and a load applied to the dumet wire 3 is reduced.

Specifically, a combination of the coupling portions 15 and the contacting portions 16 forms a U-shaped spring with the base portion 14 serving as a fixed end of the spring. Even if connection is made with the θ offset as illustrated in FIG. 6B, the free ends 18 of the contacting portions 16 are displaced in response to the offset. Therefore, θ offset is absorbed and stable contact with the ferrule 4 is assured.

Referring to FIGS. 7A to 7D, description will be made of a method of mounting the connector 1 to the second connection object.

Figure 7A:
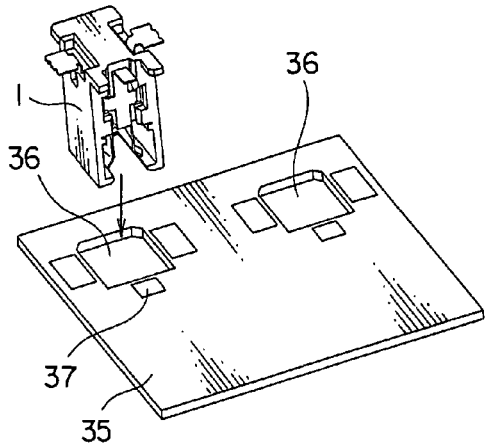
FIG. 7A is a perspective view showing a state before the connector is mounted to a board, in order to describe a method of mounting the connector in FIG. 1 to the board.

As illustrated in FIG. 7A, a board 35 is used as the second connection object. The board 35 is preliminarily provided with one or a plurality of mounting holes 36 for insertion of the connector 1. The connector 1 is inserted into one of the mounting holes 36 of the board 35.

Figure 7B:
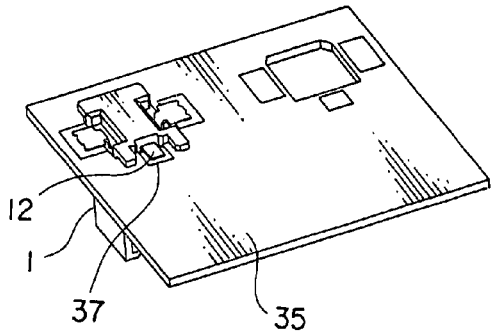
FIG. 7B is a perspective view showing a state where the connector is mounted to the board.

As a result, as illustrated in FIG. 7B, the second connecting portion 12, the hold-downs 28, and the stopper protrusions 31 are engaged with the board 35 to prevent the connector 1 from being released. In this state, the second connecting portion 12 is connected to a conductor portion 37 of the board 35 by soldering.

Figure 7C:
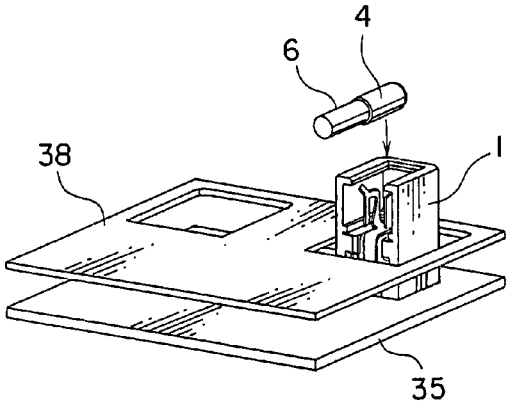
FIG. 7C is a perspective view showing a state before the connection object is connected to the connector, together with a sheet metal member.
Figure 7D:
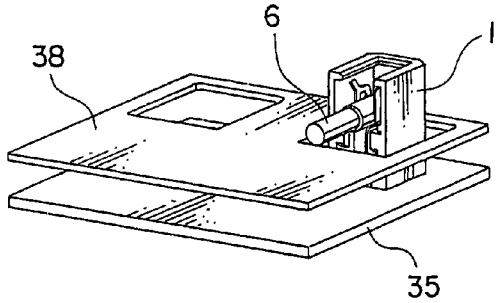
FIG. 7D is a perspective view showing a state after the connection object is connected to the connector.

As illustrated in FIG. 7C, a sheet-metal member 38 is fixed to the board 35 with a space left therefrom. Then, the first connection object 6 is inserted into the connector 1 to obtain a state illustrated in FIG. 7D.

Figure 8:
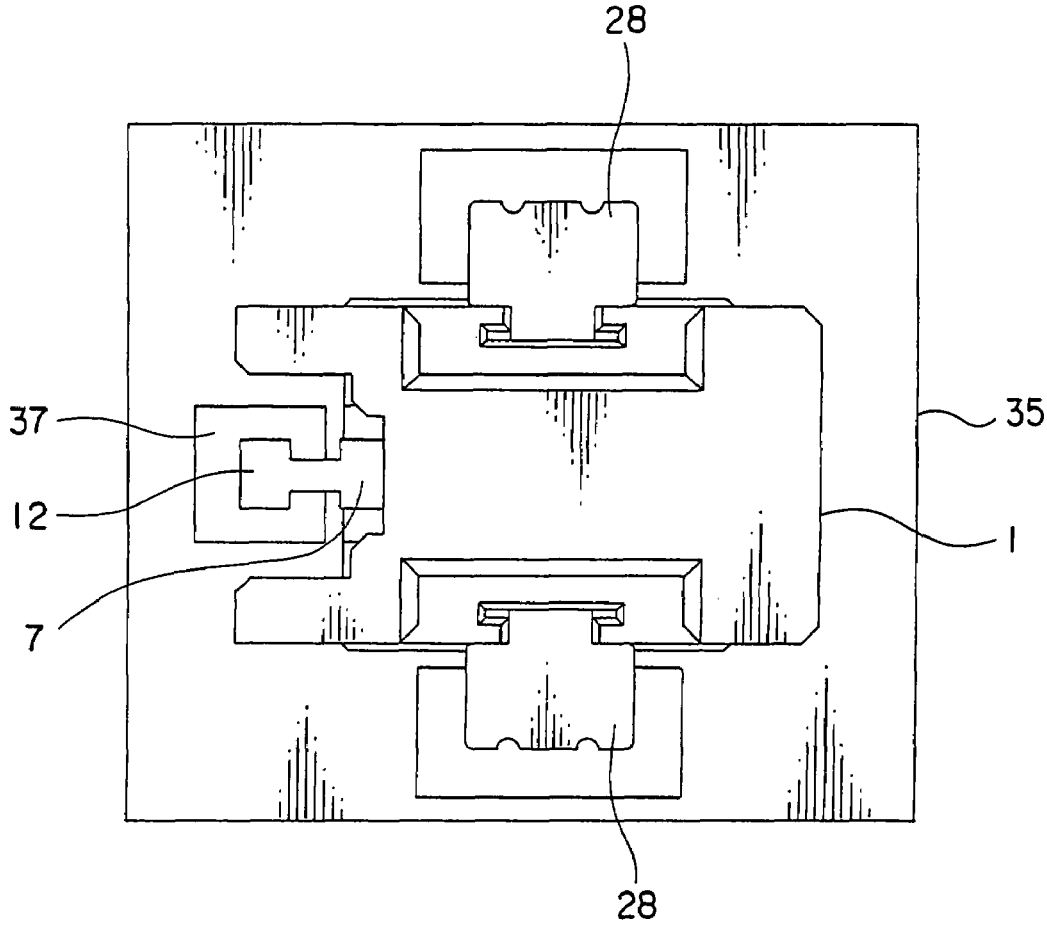
FIG. 8 is a plan view showing a modification of the connector in FIG. 1, together with a board.

Referring to FIG. 8, a modification of the connector 1 will be described. Similar parts or components are designated by like reference numerals and description thereof will be omitted.

In the modification illustrated in FIG. 8, the second connecting portion 12 of the contact 7 has a shape which is designed taking a back fillet into consideration. Specifically, the second connecting portion 12 has a widened end portion. With this structure, it is possible to increase the soldering strength between the second connecting portion 12 and the conductor portion 37 of the board 35.

Referring to FIGS. 9A to 9D, another modification of the connector 1 will be described. Similar parts or components are designated by like reference numerals and description thereof will be omitted.

The connector 1 illustrated in FIGS. 9A to 9D is adapted to be surface-mounted on one surface of the second connection object, i.e., the board, and has a cover component 39 for opening or closing the upper surface of the opening portion 22. The cover component 39 has one end rotatably coupled to the housing 8.

Figure 9A:
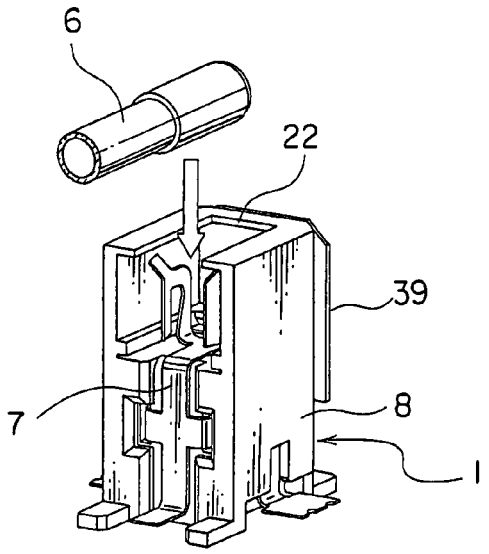
FIG. 9A is a perspective view showing another modification of the connector in FIG. 1 in a state before the connection object is connected to the connector.
Figure 9B:
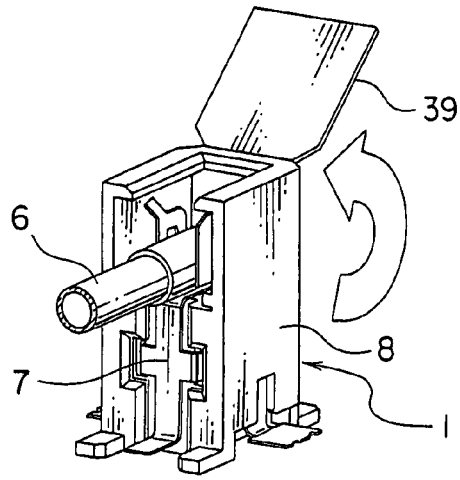
FIG. 9B is a perspective view showing a state after the connection object is connected to the connector.
Figure 9C:
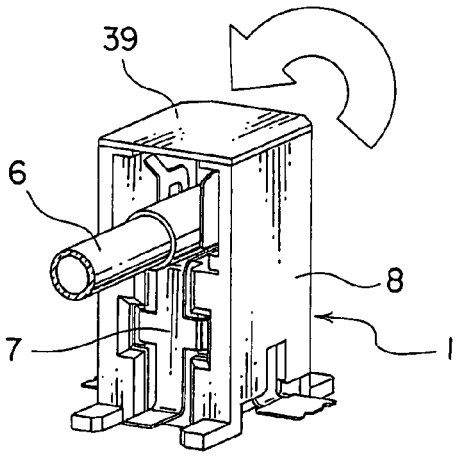
FIG. 9C is a perspective view showing a state where a cover component is closed.

As illustrated in FIG. 9A, in a state where the cover component 39 is opened, the first connection object 6 is inserted into the connector 1 via the opening portion 22. As illustrated in FIG. 9B, after the first connection object 6 is mounted at a predetermined position of the connector 1, the cover component 39 is rotated and faced to the upper surface of the housing 8 as illustrated in FIG. 9C. It is preferable to provide a mechanism for engaging the cover component 39 with the housing 8 in this state.

Figure 9D:
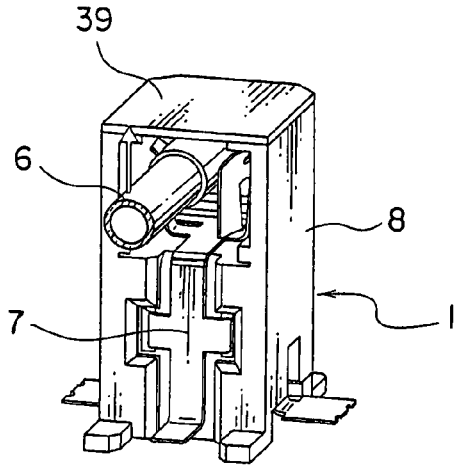
FIG. 9D is a perspective view showing a state where the connection object is going to escape from the connector.

With the connector 1 illustrated in FIGS. 9A to 9D, even if the first connection object 6 is applied with vibration to move upward as illustrated in FIG. 9D, the cover component 39 interferes so that the first connection object 6 is prevented from being accidentally released. Thus, the cover component 39 serves as a stopper component for preventing release of the first connection object 6. Accordingly, reliability in contacting is improved.

Although this invention has been described in conjunction with the exemplary embodiment thereof, this invention may be modified in various other manners.

What is claimed is:

1. A connector for connecting a first connection object and a second connection object to each other, the connector comprising:

a contact; and a housing which holds the contact;

wherein the contact includes:

a first connecting portion to be connected to the first connection object;

a second connecting portion to be connected to the second connection object; and a holding portion which is held by the housing;

wherein the first connecting portion includes:

a base portion;

a pair of coupling portions which extend from the base portion towards a first direction and are faced to each other in a second direction perpendicular to the first direction; and a pair of contacting portions which extend from the coupling portions, respectively, towards a third direction intersecting the first and second direction, and which then turn to be arranged beside the coupling portions substantially in the third direction, respectively;

wherein the contacting portions include:

fitting portions, each of which is at an end side of the first direction; and free ends, each of which is at another end side opposite to the first direction and is movable relative to each of the coupling portions; and wherein the contact is designed so that, upon connection with the first connection object, a distance between the contacting portions is narrower at the fitting portions than that at the ends.

2. The connector according to claim 1, wherein the first connection object is contacted with the contacting portions and the base portion when the connector is connected to the first connection object.

3. The connector according to claim 1, wherein a combination of the coupling portions and the contacting portions forms a substantially U-shaped spring with the base portion serving as a fixed end of the spring, the connector being arranged so that, in case where the first connection object is connected with an offset towards one of the contacting portions, the free ends of the contacting portions moving in response to the offset.

4. The connector according to claim 1, wherein the housing includes:

an insertion port through which the first connection object is inserted with guiding; and a cover member covering the insertion port.

5. The connector according to claim 1, wherein the fitting portions include a pair of tongue portions, the tongue portions extending from the fitting portions outward and away from each other and defining an insertion port for insertion of an end portion of the first connection object.

6. The connector according to claim 1, wherein the contact further includes a stopper portion extending from the base portion and engaged with the housing.

7. The connector according to claim 1, wherein the housing has a contact press-fit hole having an opening, the holding portion of the contact being press-fitted to the contact press-fit hole.

8. The connector according to claim 1, further including a metal hold-down for maintaining the connector at a predetermined position with respect to the second connection object, the housing having a hold-down press-fit hole receiving the hold-down press-fitted thereto.

9. The connector according to claim 1, wherein the housing has a flat sucking surface adjacent to the hold-down press-fit hole.

10. The connector according to claim 1, wherein the housing includes:

a stopper protrusion for preventing the connector from being released from the second connection object; and a distinct-shaped portion for preventing the connector from being erroneously mounted to the second connection object.

11. The connector according to claim 1, wherein the housing has an opening portion for insertion of the first connection object.

12. The connector according to claim 11, including a cavity formed continuously from the opening portion to receive the first connecting portion, the base portion of the contact being disposed in the cavity.

13. The connector according to claim 11, further including a cover component adapted to open and close the opening portion, the cover component having one end rotatably coupled to the housing.

* * * * *